United States Patent [19]

Underwood

[11] 4,218,957

[45] Aug. 26, 1980

[54] FLOW CONTROL VALVE

[75] Inventor: Herbert N. Underwood, Chicago, Ill.

[73] Assignee: Borg-Warner Corporation, Chicago, Ill.

[21] Appl. No.: 839,088

[22] Filed: Oct. 3, 1977

[51] Int. Cl.[2] ..... F15B 11/08; F15B 13/042

[52] U.S. Cl. ..... 91/421; 91/446; 91/451; 137/106

[58] Field of Search ..... 91/421, 446, 451; 137/98, 102, 106

[56] References Cited

U.S. PATENT DOCUMENTS

| | | | |
|---|---|---|---|
| 2,028,766 | 1/1966 | Ernst et al. | 91/421 X |
| 2,464,283 | 3/1949 | Adams | 91/421 |
| 2,501,483 | 3/1950 | Taylor | 91/421 |
| 2,665,704 | 1/1954 | Kanuch | 137/115 X |
| 3,359,761 | 12/1967 | Underwood et al. | 60/698 X |
| 3,443,381 | 5/1969 | Underwood et al. . | |
| 3,443,405 | 5/1969 | McAninich et al. | 68/23.7 |
| 3,584,538 | 6/1971 | Petersen | 91/421 |
| 3,908,688 | 9/1975 | Gandrud | 91/421 X |
| 4,089,167 | 5/1978 | Budzich | 91/421 X |

*Primary Examiner*—Irwin C. Cohen
*Attorney, Agent, or Firm*—Robert L. Zieg

[57] ABSTRACT

A flow control valve in fluid communication with a variable orifice which is utilized to control speed of a fluid motor, the valve providing a constant pressure drop across the variable orifice whereby consistent control of speed of the motor may be maintained.

3 Claims, 1 Drawing Figure

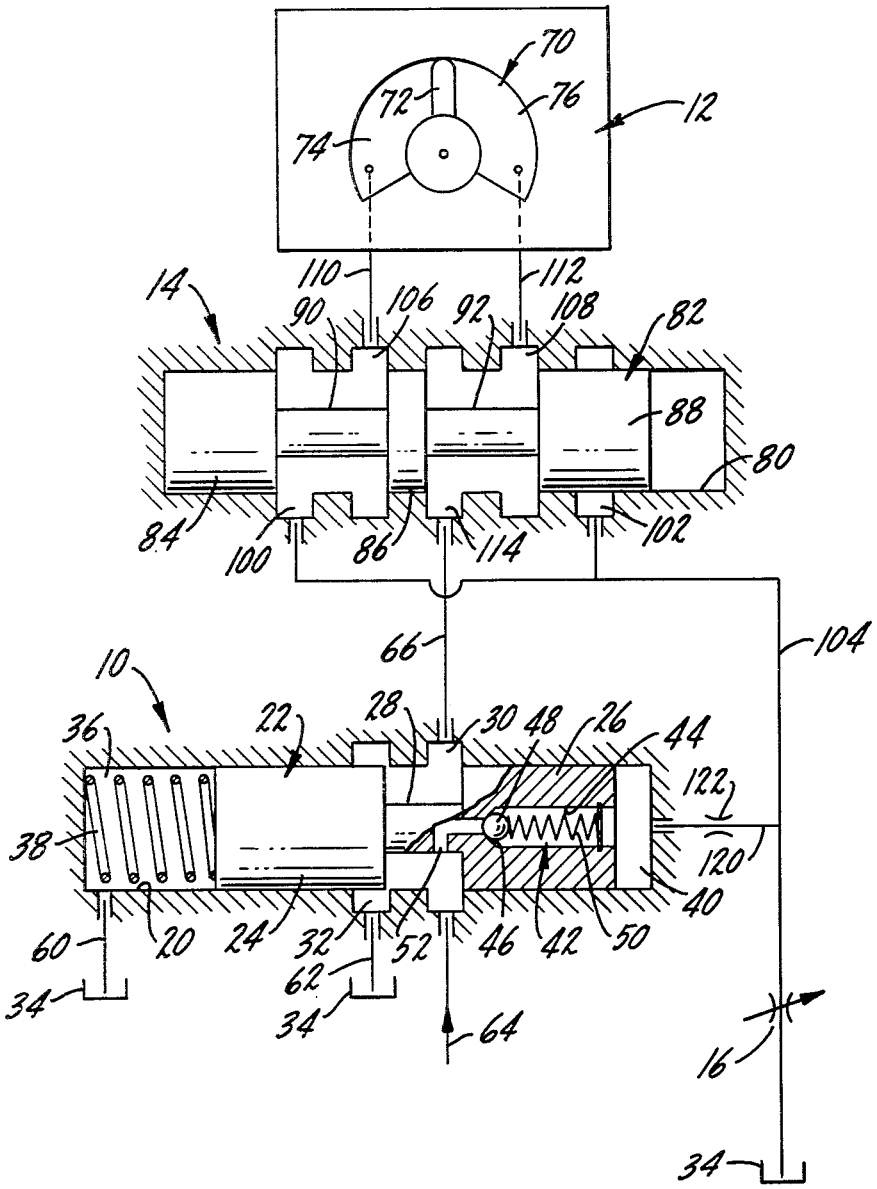
70
72
76
12
74
110
112
14
90
106
92
108
82
88
80
84
100
86
114
102
66
104
10
36
22
28
30
48
26
44
122
38
120
40
60
20
24
32
52
46
42
50
62
34
34
64
16
34

FLOW CONTROL VALVE

BACKGROUND OF THE INVENTION

1. Field of the Invention

This invention pertains to the field of flow control valves for hydraulic mechanisms.

2. Prior Art

It is known in the prior art to provide control valve mechanisms and variable size orifices to provide for control of fluid devices. The problem recognized, is to provide a simple and easily manufactured flow control mechanism which will provide consistent flow control over a range of pressures, include a means to provide over pressure protection in the system, and control input flow to the motor by sensing output flow.

SUMMARY OF THE INVENTION

The present invention solves the above identified problems in the prior art of controlling flow through a flow control orifice in that a simple slidable valve is provided which senses the pressure ahead of an orifice and provides a constant pressure drop between a return port from fluid motor mechanism and the sump. The flow control valve is thus sensitive to the fluid exhaust condition from the fluid motor. The piston type valve is independent of various inlet pressure levels and maintains a constant pressure drop across the control orifice in the fluid exhaust line from the fluid motor and thus can provide for precise control of the fluid motor by means of the variable orifice.

The invention as described above, is particularly useful in the field of hydraulic motors for clothes washing machines in which an agitation cycle is required wherein the fluid actuator must be of the reversing type and the best control is provided by a variable orifice on the outlet side of the fluid motor. The control valve is connected to the outlet side of the fluid motor and controls the inlet supply to the fluid motor to conveniently provide for control of the motor speed by means of the pressure drop across the variable orifice.

BRIEF DESCRIPTION OF THE DRAWINGS

The single FIGURE of the drawing is a schematic representation of a hydraulic control circuit incorporating the valve of the present invention.

DETAILED DESCRIPTION OF THE PREFERRED EMBODIMENT

Referring to the single FIGURE of the drawing, there is shown a unique flow valve 10 in an environment including a fluid motor 12, a reversing valve 14 and a variable orifice 16 represented schematically. Briefly, the valve 10 controls the pressure drop between the outlet of the fluid motor and the sump across orifice 16 to keep the pressure drop constant and thereby provide consistent control by means of variable orifice 16. Thus, consistent control of the speed of the fluid motor is provided by change of the size of orifice 16.

Valve 10 includes a valve bore 20 in which is slidable a piston member 22 having lands 24 and 26 thereon separated by groove 28. A pressure port 30 and an adjacent exhaust port 32 are provided in communication with the bore 20. A fluid sump 34 is illustrated schematically throughout the fluid circuit. Land 24 together with the valve bore 20 define a spring chamber 36 at one end of the valve having a coil spring 38 therein in contact with land 24, and urging the valve piston to the right as illustrated. At the opposite end of valve 10 a pressure chamber 40 is defined by the land 26 and the bore 20. A pilot relief valve 42 is provided in land 26 which comprises a bore 44 having at the end thereof a conical valve seat 46. A ball 48 is engageable with seat 46 and a spring 50 is provided in bore 44 urging the ball into engagement with the seat. A fluid passage 52 connects groove 28 to the pilot relief valve 42.

A conduit 62 connects port 32 to sump 34. A conduit 64 connects a port 30 to a source of fluid pressure not illustrated. A conduit 66 connects port 30 to reversing valve 14.

The motor 12 comprises a fluid chamber 70 having a rotatable vane 72 therein which divides the motor into a pair of fluid chambers 74 and 76. The reversing valve 14 comprises a valve bore 80 having a valve piston 82 slidable therein. Piston 82 has lands 84, 86 and 88 thereon. Lands 84 and 86 are separate by a groove 90 and lands 86 and 88 are separated by groove 92. Valve 14 includes outlet ports 100 and 102 connected to an outlet passage 104. Valve 14 further includes ports 106 and 108 connected to chambers 74 and 76 by passages 110 and 112 respectively. The valve 14 further includes a pressure inlet port 114. As described above the outlet passage 104 from reversing valve 14 and motor 12 has included therein a variable orifice 16. As will be obvious to those of ordinary skill in the art, orifice 16 can be, for example, a manually adjustable valve having a variable orifice thereon.

The chamber 40 of valve 10 is connected to passage 104 by conduit 120. Conduit 120 has a restriction or orifice 122 therein.

The fluid motor 12 illustrated in the drawing and described herein, is only an example, of a fluid motor which can be controlled by valve 10. The vane motor 12 which is illustrated is the type which can be used to provide the agitation drive for a washing machine having a hydraulic transmission. The motor 12 is a reversible fluid motor in which when the vane 72 reaches the end of the stroke in one direction, suitable porting is provided to change the position of the reversing valve 14 to change the pressure supply from one fluid chamber to the other in the fluid motor, and thus drive the motor in the reverse direction to provide the oscillating motion for driving the agitator of the washer. The porting which is to be provided to change the position of the reversing valve to reverse the vane at the end of its stroke, is not illustrated in the subject application but is illustrated in, U.S. Pat. No. 3,359,761 of common assignee, filed Dec. 13, 1965, which patent may be referred to for a complete understanding of the operation of the reversing valve and the oscillating fluid motor 12.

Operation of Circuit

Fluid pressure supplied to port 30 through conduit 64 will be supplied through conduit 66 to pressure port 114 of valve 14, and if the valve is in the position illustrated, the pressure will be connected to conduit 112 to chamber 76 to move the vane 72 in a counterclockwise direction. When the vane reaches the end of this movement in a counterclockwise direction the pressure will act on the left end of the valve 14 to move the valve piston 82 to the right, in which groove 90 of the valve would then connect the pressure supply port 114 through conduit 110 to chamber 74 to drive the vane 72 in the opposite direction. With the valve 14 in the position illustrated, the chamber 74 is connected through port 106 and port 100 to outlet passage 104. Variable orifice 16 is provided in conduit 104 and by adjustment of the size thereof, the flow of exhaust fluid from chamber 74 and port 100 will be sensed and thereby control the supply of fluid to the motor and the speed of movement of vane 72.

Obviously a pressure differential will exist between the return line 104 and the sump 34. The function of the valve 10 is to provide a constant pressure drop between the exhaust from motor 12 and sump 34 to provide for reliable and consistent control of flow and thus speed by orifice 16. The pressure in conduit 104 is connected through conduit 120 and orifice 122 to chamber 40. Thus valve piston 22 has pressure in chamber 40 from passage 104 acting on land 26 in opposition to spring 38.

When the pressure in chamber 40 exceeds the setting of the spring 38, valve piston 22 will move such that land 24 uncovers exhaust port 32 connecting fluid supply in port 30 to the sump through conduit 62, and thus reducing the fluid supply to motor 12 through conduit 66. Thus a pressure balance exists between conduit 104 and sump 34, thus outlet pressure from motor 12 will be maintained depending upon the size of land 26 receiving the pressure in passage 104 and the size of spring 38. In one example of a hydraulic transmission which was constructed, the spring 38 was of a size to provide a 10 PSI pressure drop between conduit 104 and sump 34.

The amount of fluid supplied to the fluid motor or rotary actuator 12 will be dependent upon the adjusted size of orifice 16. The flow of fluid through orifice 16 will induce a pressure buildup in conduit 104 ahead of the orifice. The greater the flow of fluid past orifice 16, the greater will be the pressure in conduit 104. As described above, this pressure acts on land 26 of valve 10 in opposition to spring 38. Thus, if the spring is set to provide a value of 10 PSI, the flow control orifice 16 will allow a flow which will create a 10 PSI drop across the orifice 16. If the flow is greater, the pressure will increase beyond 10 PSI causing the valve 10 to move toward the spring resulting in more of the flow from the pump to be bypassed to the sump before entering the rotary actuator, and the flow of fluid through orifice 16 will be less, thus the speed of the actuator 12 will be slower. On the other hand if the flow through the orifice 16 is too low, the pressure in conduit 104 ahead of the orifice will be less than the setting of spring 38 and the valve piston 22 will be moved to the right reducing the amount of fluid being bypassed to sump, thus increasing the flow through flow control orifice 16 and increasing the speed of the rotary actuator.

Thus by provision of the unique bypass or flow control valve 10 a constant pressure drop is maintained across the orifice 16 providing for reliable and consistent control of the speed of the actuator 12. As indicated above, the valve 10 is illustrated as used with a reversible hydraulic motor 12, however as will be apparent the valve can be used in control of linear type motors and other systems where a constant pressure drop is to be maintained across an orifice to provide a consistent control of flow.

The pilot relief valve 42 provided in piston 22 is such as to prevent an over pressure condition. If a pressure is sensed in inlet port 30 and groove 28 exceeding a predetermined amount, ball 48 will be moved from its seat against the force of spring 50 and will connect the inlet pressure to chamber 40, the pressure will act on land 26 to move piston 22 to the left to uncover exhaust port 32 and relieve fluid and thus the pressure. This action is caused by the fact that the pressure in chamber 40 acting on land 26 is maintained by means of the flow through pilot relief valve 42 and orifice 122 causing valve 10 to move to the left against spring 38.

I claim:

1. The combination of a flow control valve with a fluid actuated motor, the motor having an exhaust line and a pressure supply line, said flow control valve being connected between a source of fluid pressure and said fluid supply line, a variable orifice in the exhaust line, said flow control valve being connected to said exhaust line so that the supply of fluid to said fluid actuated motor is controlled by said fluid control valve in response to the pressure in said exhaust line, a sump connected to said exhaust line, said flow control valve having a connection to said sump such that an increase in flow and thus an increase of pressure in said exhaust line urges said flow control valve in a direction tending to connect said supply line to said sump and thereby decrease the flow and thus the pressure in the exhaust line, said flow control valve defining a pressure chamber therein, a conduit extending between said pressure chamber and said exhaust line upstream of said variable orifice, a valve piston in said valve pressure chamber having the pressure in said chamber imposed thereon, a spring positioned to abut the piston and urge the piston in a direction tending to interrupt the connection to the sump, a restriction in the conduit extending between the pressure chamber and the exhaust line, said flow control valve including an inlet connected to the source of fluid pressure, and an over-pressure relief valve connected between said inlet and said conduit extending between said pressure chamber and said exhaust line at a point upstream of said restriction and said pressure chamber, whereby an over-pressure condition will move said flow control valve to relieve pressure.

2. The combination of claim 1, wherein said valve piston has a bore therein in which said over-pressure relief valve is mounted.

3. The combination of claim 2, wherein said over-pressure relief valve comprises a ball valve having a ball engageable with a seat provided in said valve piston.

* * * * *